US007644841B2

(12) United States Patent
Brainard et al.

(10) Patent No.: US 7,644,841 B2
(45) Date of Patent: Jan. 12, 2010

(54) BLISTER PUMP DISPENSER

(76) Inventors: John P. Brainard, 6000 Silver Leaf Trail NE., Albuquerque, NM (US) 87111; Terry A. Gugliotta, P.O. Box 50093, Albuquerque, NM (US) 87181; Beatrice A. Atchison, 208 Fox Dr., Del Rio, TX (US) 78840

( * ) Notice: Subject to any disclaimer, the term of this patent is extended or adjusted under 35 U.S.C. 154(b) by 561 days.

(21) Appl. No.: 11/525,448

(22) Filed: Sep. 22, 2006

(65) Prior Publication Data

US 2007/0075096 A1 Apr. 5, 2007

Related U.S. Application Data

(60) Provisional application No. 60/723,342, filed on Oct. 4, 2005.

(51) Int. Cl.
*B65D 37/00* (2006.01)

(52) U.S. Cl. ..... 222/211; 222/622

(58) Field of Classification Search ..... 222/207, 222/211, 632, 633, 213, 464, 628, 189.1, 222/511, 380

See application file for complete search history.

(56) References Cited

U.S. PATENT DOCUMENTS

| | | | | |
|---|---|---|---|---|
| 1,219,714 | A | 3/1917 | Eberly | |
| 2,267,280 | A | 12/1941 | Kuhnel | |
| 2,679,337 | A | 5/1954 | Leach | |
| 2,702,147 | A | 2/1955 | Brown | |
| 3,409,184 | A | 11/1968 | Stengle | |
| 3,452,905 | A | 7/1969 | Micallef | |
| 3,910,458 | A | 10/1975 | Ewald | |
| 4,087,024 | A | 5/1978 | Martin et al. | |
| 4,179,051 | A | 12/1979 | Thomas | |
| 4,573,613 | A * | 3/1986 | de Freitas | 222/213 |
| 4,828,149 | A * | 5/1989 | Hester | 222/207 |
| 5,664,703 | A * | 9/1997 | Reifenberger et al. | 222/207 |
| 6,406,207 | B1 * | 6/2002 | Wiegner et al. | 401/272 |
| 6,488,185 | B2 | 12/2002 | Beranger et al. | |
| 6,592,010 | B2 | 7/2003 | Plessis | |
| 6,705,492 | B2 | 3/2004 | Lowry | |
| 6,805,267 | B2 * | 10/2004 | Bougamont | 222/633 |
| 6,824,015 | B1 | 11/2004 | Ammann | |
| 6,929,156 | B2 | 8/2005 | Petit et al. | |
| 2003/0132252 | A1 * | 7/2003 | Rossignol | 222/207 |

FOREIGN PATENT DOCUMENTS

| | | | | |
|---|---|---|---|---|
| JP | 5-312456 | * 11/1993 | | 222/207 |
| JP | 9-4000 | * 2/1997 | | 222/207 |
| JP | 2003-118760 | * 4/2003 | | 222/207 |
| JP | 2004-75149 | * 3/2004 | | 222/207 |

* cited by examiner

*Primary Examiner*—Lien T Ngo

(57) ABSTRACT

A manually operated dispenser of the type containing a diaphragm at the bottom of the bottle, such that when the diaphragm is compressed a quantity of fluid is dispensed above the bottle through a spout. This invention uses a unique diaphragm shaped like a blister, that is integrated into the bottle bottom with a slide-pin allowing the blister diaphragm to move up and down, but not side to side. The diaphragm seals to the bottle bottom during dispensing, but when the diaphragm is substantially compressed, the seal self breaks as the diaphragm edge expands radially from the diaphragm axis over bumps on the bottle bottom allowing the diaphragm to refill. At the fluid output of the spout is a channel valve nozzle that channels the fluid into a stream when the fluid flows, but when the fluid is not being dispensed, prevents fluid from flowing back into the bottle.

20 Claims, 5 Drawing Sheets

Detail A

Detail B

A

B

C

BLISTER PUMP DISPENSER

CROSS-REFERENCE TO RELATED APPLICATIONS

This application claims the benefit of provisional patent application Ser. No. 60/723,342 filed 2005 Oct. 4 by the present inventors.

FEDERALLY SPONSORED RESEARCH

Not Applicable.

SEQUENCE LISTING OR PROGRAM

Not Applicable.

BACKGROUND OF INVENTION

1. Field of Invention

This invention is related to the countertop small manually operated fluid dispensers used for hand creams, lotions, soaps, etc. commonly found in household kitchens, bathrooms, and laundry rooms.

2. Prior Art

Most of these dispensers are of the type where a spout, mounted on the cap of a bottle containing fluid, is depressed by the thumb and a relatively small quantity of fluid from the bottle is dispensed through the spout into the fingers of the same hand; that is, a one handed manual dispenser. Fluids include soap, hand cream, and skin lotion. Some of these devices are used to dispense food condiments such as mustard, ketchup, mayonnaise, etc. In this case, the fluid is commonly dispensed directly onto food, onto a plate of food, or on a side dish. These dispensers have been very popular because they are less messy and more sanitary than removing fluid by squeezing a tube, by dipping an opened jar with serving utensils or with fingers (cold cream for example).

Typical examples of today's dispensers are found in U.S. Pat. Nos. 6,488,185 to Beranger et al, and 6,929,156 to Petit et al. This is based on inspection of dozens of popular dispensers sold today. These modern dispensers are very complex requiring 12 to 15 precision parts for a pump using a piston/cylinder system, at least two check valves, and a means of venting the bottle to prevent a vacuum from forming in the bottle as the volume of fluid is removed. These pumps are becoming prohibitively expensive and these dispensers can add up to 30% to the price of the fluid. Many fluids are now offered in either a pump dispenser (for a few dollars more) or a cheaper squeeze tube.

Because these pumps and valves are placed just under the cap of the fluid container, the output check valve is far from the end of the spout and fluid is always left in the spout to dry out, or to become contaminated with germs in the case of multiple users. The fluid will also run out of the spout if the bottle is tipped. In addition, this pump must suck fluid through a tube that has its open end near the bottom of the bottle. This leaves the user having to throw out (or bottom fish for) the last ounce of fluid. In other words, the suction is lost when the pump starts to suck air when the bottle is not completely empty.

The U.S. Pat. Nos. 2,702,147 to Brown (1955) and 3,409,184 to Stengle (1968) use a different type of pump than the piston/cylinder pump. The pumps of both patents use a collapsible volume (diaphragm) at the bottom of the fluid bottle that pushes rather than sucks the fluid through to the top spout. Unfortunately Brown's dispenser, which is fully integrated into the fluid bottle, is as complex as today's dispensers. This integration would clearly limit the bottle style. Precision parts are still required for sealing the collapsible volume into the bottom of the bottle, and two check valves are required. The spout and tube are left filled with fluid that can dry and clog the spout. The fluid will also spill out if the bottle is tipped. The long thin channel required to input fluid to the diaphragm would delay the reset of the diaphragm as it expands back into natural shape and would be problematic for more viscous fluids like lotions or creams. This wait time would frustrate the user. The flexing of the hemispherical thick-walled diaphragm is rather extreme, which would prematurely tear or rupture over time. The design of the diaphragm is critical (especially if the properties change with time), because if it does not reset, the pump will fail. In all, this dispenser offers no advantage over current dispensers.

Stengle's device (U.S. Pat. No. 3,409,184) has the simplicity we are looking for, but unfortunately it does not have the quality of today's dispenser. Stengle uses a bellows for the collapsible volume with holes at the bottom pleat to introduce the fluid into the bellows. The holes are closed against the bottom of the bottle when the bellows begins to expand (reset) and wide open when the bellows starts to compress (when the spout is pushed down). This is 180 degrees out of phase for an efficient pump. Most of the fluid will move out of the holes rather than up the connecting tube/spout when the bellows is compressed, and the fluid cannot easily move into the bellows until the bellows expands. The long wait time for the bellows to reset would be similar to Brown's U.S. Pat. No. (2,702,147). The volume of fluid dispensed (if any) would depend on how fast the user compresses the bellows. Because the fluid in the connecting tube and spout drains back into the bellows between dispensing, drying in the spout is not an issue unless the fluid is viscous. But the user must re-fill the tube and spout volumes with each compression of the bellow before fluid exits the spout, which results in a significant delay before the fluid is dispensed. This also means the volume dispensed would depend on the height of the fluid level in the fluid bottle. Venting of the bottle is done through the spout which will partially fill the bellows with air, thus making the pump even less efficient. Fluid will also run out if the bottle is tipped. In addition, from Applicants' experience, without the diaphragm/bellows being integrated to the bottom of the bottle, the bellows will slide around and tip the spout in different directions. In all, this dispenser would be considered to be of poor quality by the user.

OBJECTS AND ADVANTAGES

Applicants wished to invent a new dispenser that would have several beneficial features over today's dispensers. Surprisingly, they not only met their goal, but discovered a novel way to simplify the dispensers found in the market place. Accordingly, several objects and advantages of Applicants' dispenser are as follows:

a) A manual dispenser that is of high quality. That is, the device dispenses a constant volume, works efficiently, is properly vented, and is of sturdy construction.

b) A dispenser that is inexpensive with fewer and simpler parts with relaxed tolerances and substantially less fabrication time.

c) A fluid dispenser where the fluid does not dry and clog in the spout or become contaminated by air born germs (especially important with multiple users and when dispensing food).

d) A dispenser that will not spill fluid when the bottle is tipped, preventing a mess and waste.

e) A dispenser that dispenses the last ounce of fluid in the bottle for reduced waste.

Other objects and advantages are that the fluid will not drip from the spout, and the dispenser can be easily locked for travel to prevent the possibility of leaking. Still further objects and advantages will become apparent with the ensuing description and drawings.

SUMMARY

In accordance with the present invention, a fluid dispenser uses a diaphragm of special shape centered on a vertical axis at the internal bottom of a bottle of fluid. This diaphragm has an opening on the top and on the bottom. When the top of the diaphragm is compressed toward the bottle bottom, a seal is formed between the bottom edge of the bottom opening and internal bottom, and fluid within the diaphragm is forced up through a tube that is attached to the top opening of the diaphragm and a spout above the bottle that is attached to the top of the tube. The unique feature of this diaphragm is that the bottom edge of the bottom opening expands substantially radially on the bottle bottom relative to the vertical axis of the diaphragm as the diaphragm is compressed. This unique feature led to innovative ways to release the seal and allow the diaphragm to refill for the next cycle of dispensing, thus eliminating the need for a lower check valve. The diaphragm is called the blister diaphragm which suggests its shape. This along with a special nozzle at the exit end of the spout, is called the blister pump dispenser. Amazingly this dispenser can be made from as few as 5 parts including bottle and bottle cap.

DRAWINGS

Figures

Figure 1:
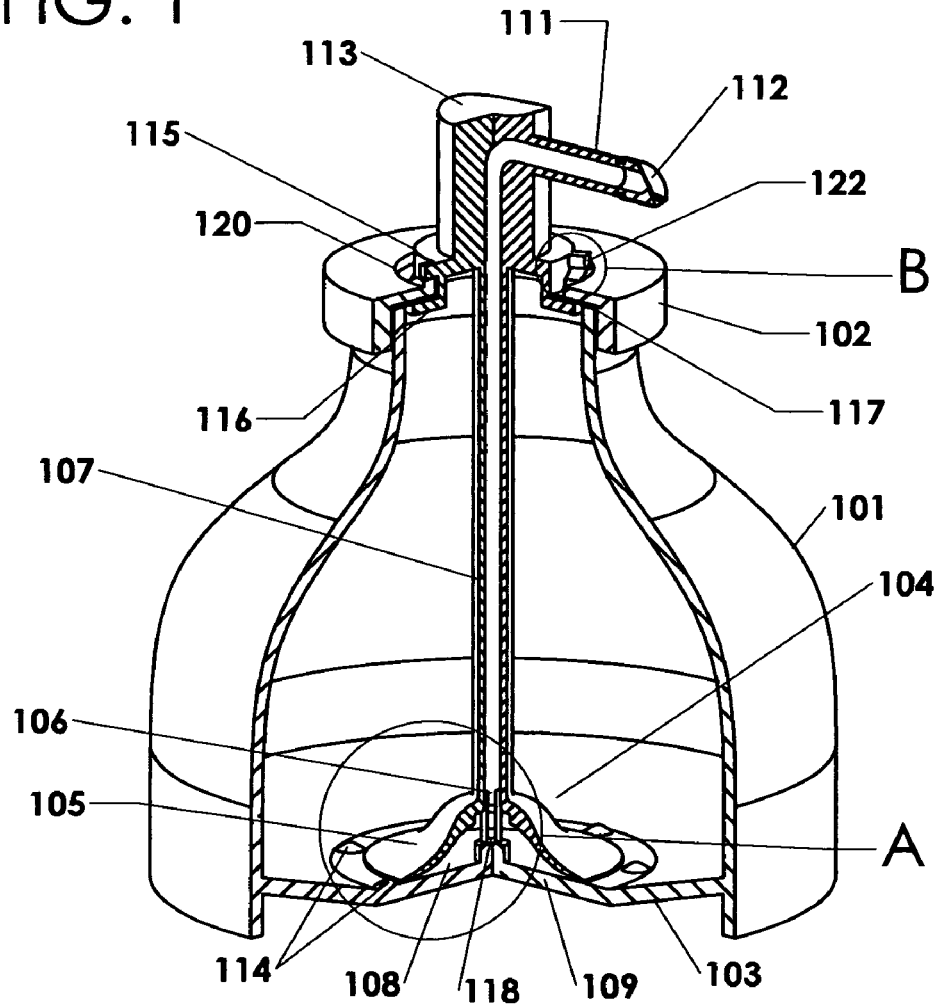
FIG. 1 shows various aspects of a preferred embodiment.
Figure 1:
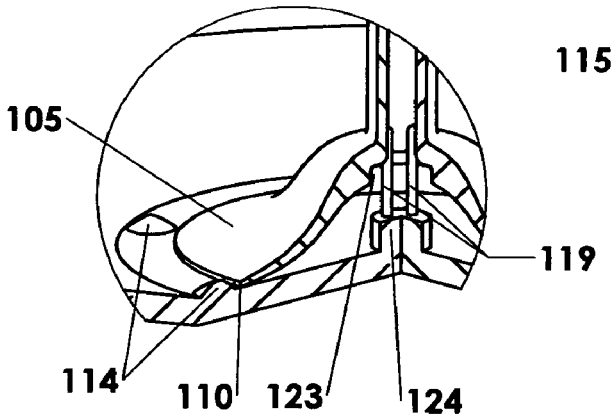
Figure 1:
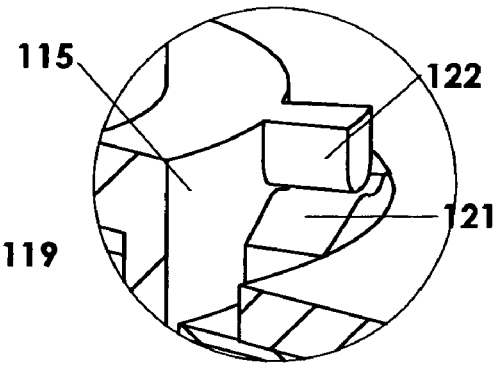

| DRAWINGS—Reference Numerals Associated with the Figures |
|---|
| FIG. 1 below |
| 101 bottle |
| 102 bottle cap |
| 103 funnel bottom |
| 104 blister pump |
| 105 blister diaphragm |
| 106 top opening |
| 107 tube |
| 108 bottom opening |
| 109 internal bottle bottom |
| 110 seal |
| 111 spout |
| 112 channel valve nozzle |
| 113 thumb saddle |
| 114 bumps |
| 115 skirts |
| 116 flange |
| 117 gasket-seal |
| 118 slide-pin |

-continued

Figure 3:
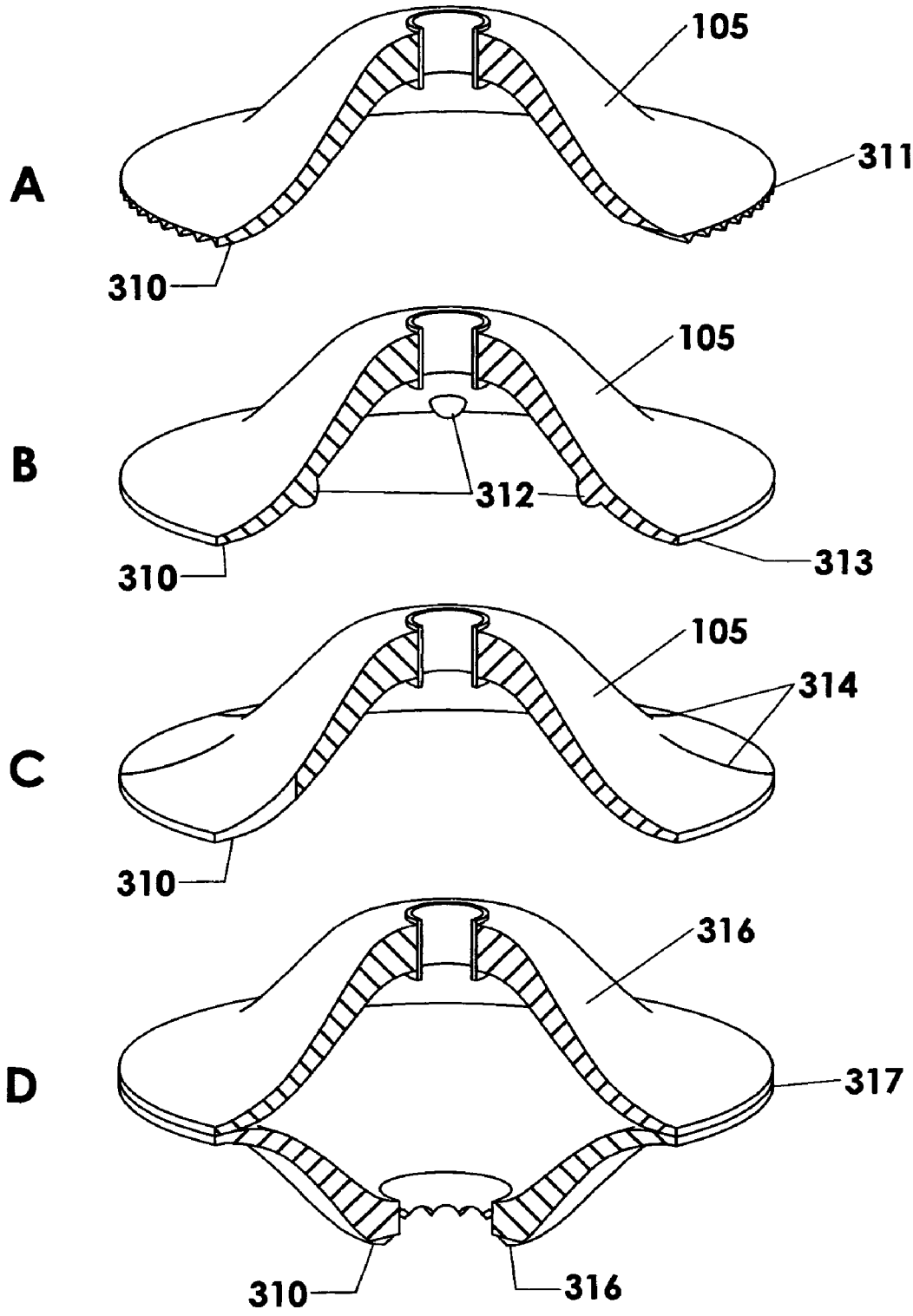
FIGS. 3A to 3D show views of blister diaphragm options with different release mechanisms.
Figure 4:
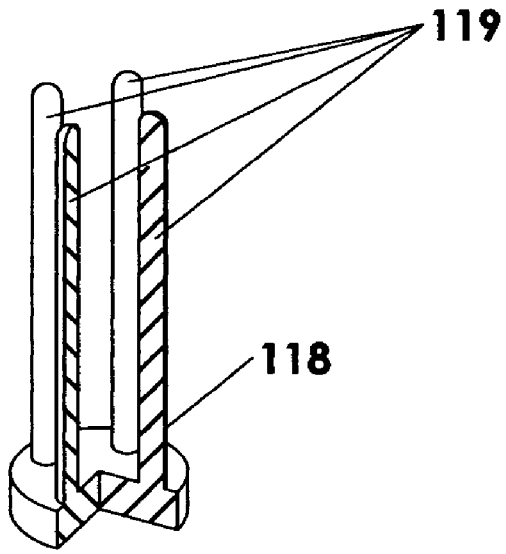
FIGS. 4A to 4C show views of alternative slide-pin options.
Figure 4:
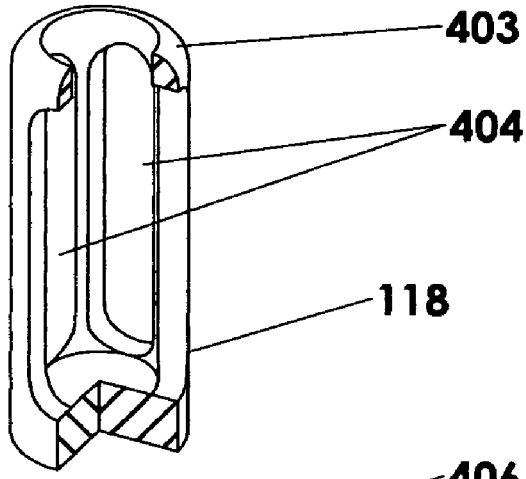
Figure 4:
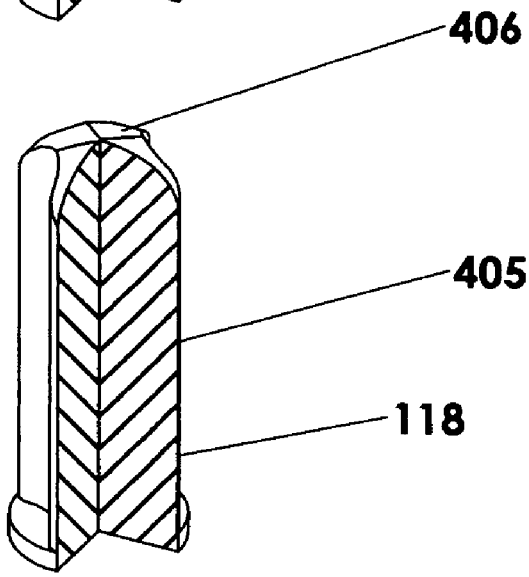
Figure 5:
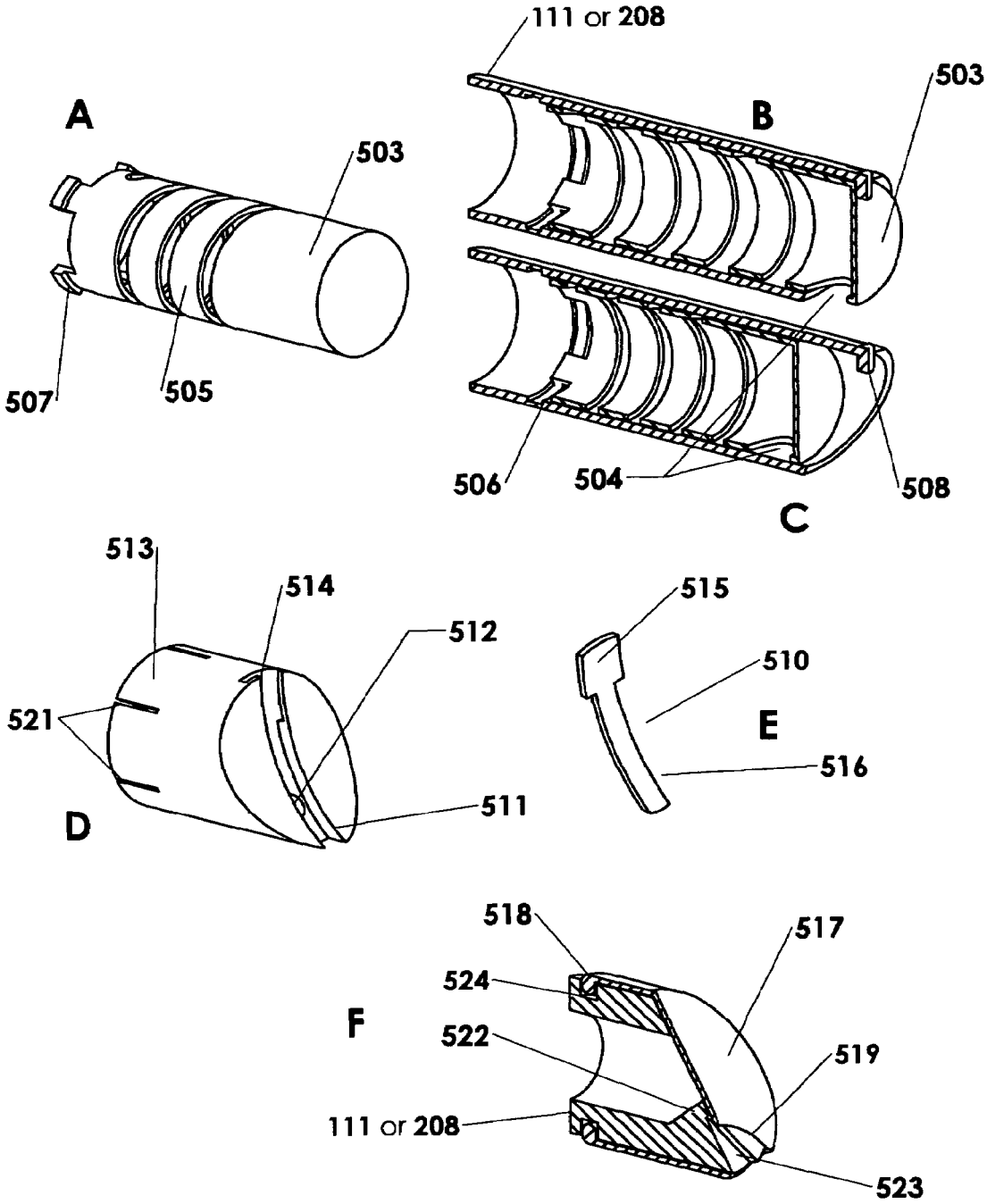
FIGS. 5A to 5F show views of alternative channel valve nozzle options.

| DRAWINGS—Reference Numerals Associated with the Figures |
|---|
| 119 legs |
| 120 cap hole |
| 121 cap tabs |
| 122 skirt tabs |
| 123 shoulder |
| 124 boss |
| FIG. 2 below |
| 200 alternative blister pump |
| 201 rod |
| 202 alternative bottle cap |
| 207 flexible tube |
| 208 alternative spout |
| 209 rod groove |
| 210 alternate cap hole |
| 211 gasket |
| 212 alternate thumb saddle |
| 214 compression spring |
| 215 lock fingers |
| 216 rod tee |
| FIG. 3 below |
| 310 edge seal |
| 311 rough surface |
| 312 fulcrum bumps |
| 313 outer edge |
| 314 slits |
| 316 double-blister diaphragm |
| 317 sewed edge |
| FIG. 4 below |
| 403 cylinder |
| 404 slots |
| 405 post |
| 406 star cross-section |
| FIG. 5 below |
| 503 piston |
| 504 side hole channel |
| 505 cylindrical spring |
| 506 inner spout groove |
| 507 spring fingers |
| 508 stop |
| 510 leaf spring |
| 511 channel |
| 512 |
| 513 housing |
| 514 key way |
| 515 wide end |
| 516 narrow end |
| 517 balloon |
| 518 rolled edge |
| 519 balloon hole |
| 521 inner spring fingers |
| 522 thickened edge |
| 523 conical partial channel |
| 524 outer spout groove |

DETAILED DESCRIPTION

A preferred embodiment of the dispenser is illustrated in FIG. 1. A bottle 101 filled with fluid (fluid not shown) has a bottle cap 102 and a funnel bottom feature 103 that directs fluid toward the blister pump 104. The bottle cap 102 with a cap hole 120 is fastened to the bottle 101 using typical means such as threads, snap-on, or other techniques. The blister pump 104 uses a diaphragm 105 that is shaped something like a suction cup with similar flexing properties. The blister diaphragm 105 has a top opening 106 which communicates with the tube 107, and bottom opening 108 that rests against the more or less flat internal bottle bottom 109. Top opening 106 and bottom opening 108 are more or less concentric to a vertical axis. Blister diaphragm 105 has a natural shape that it always returns to after it is deformed or compressed. When blister diaphragm 105 is compressed against the internal bottle bottom 109, a seal 110 (see FIG. 1, detail A) is formed at the internal bottle bottom 109 and the fluid within the blister diaphragm 105 is forced out the top opening 106, through the tube 107, through the series spout 111 and the series channel valve nozzle 112. Channel valve nozzle 112 only allows fluid to flow in one direction out of the dispenser, and air cannot re-enter the channel valve nozzle 112 to dry out the fluid in the spout 111. The compression is accomplished by pressing tube 107 by means of the thumb saddle 113. This means that tube 107 must be reasonably rigid. When pressure on thumb saddle 113 is released, blister diaphragm 105 tries to return to its natural state as fluid refills the blister diaphragm 105 from the internal bottle bottom 109. To do this, the seal 110 must be released as the thumb saddle 113 is near the end of its downward travel. Once the seal 110 is broken and the thumb saddle 113 is released, fluid rapidly flows back into the blister diaphragm 105. The channel valve nozzle 112, prevents refilling from the tube 107 and spout 111 regions. The fluid flow prevents the seal 110 from reforming as the blister diaphragm 105 refills. The Blister Pump 104 includes the blister diaphragm 105 centered at the internal bottle bottom 109, the bottom opening 108 with a release mechanism of seal 110, and a channel valve nozzle 112 above the blister diaphragm 105 that communicates with the top opening 106. The tube 107 and spout 111 are simply a means of transferring fluid from the blister diaphragm 105 to the nozzle 112. One advantage of this Blister Pump 104 is that it allows the dispenser to remove the last ounce of fluid from the precise internal bottle bottom 109. Applicants have shown that the last ounce of fluid can be forced out the spout with air in the diaphragm 105. The unique feature of the blister diaphragm 105 is that the bottom edge of the bottom opening 108 expands radially with respect to its vertical axis as blister diaphragm 105 is flattened against the internal bottle bottom 109. Applicants used this feature to release the seal 110. In FIG. 1, detail A, the release or self-breaking mechanism shows a plurality of bumps 114 as part of the internal bottle bottom 109 just outside of the bottom edge of the bottom opening 108. When the bottom edge expands radially over these bumps 114 upon compression of blister diaphragm 105, the seal 110 is released or broken to allow fluid to refill blister diaphragm 105.

Figure 2:
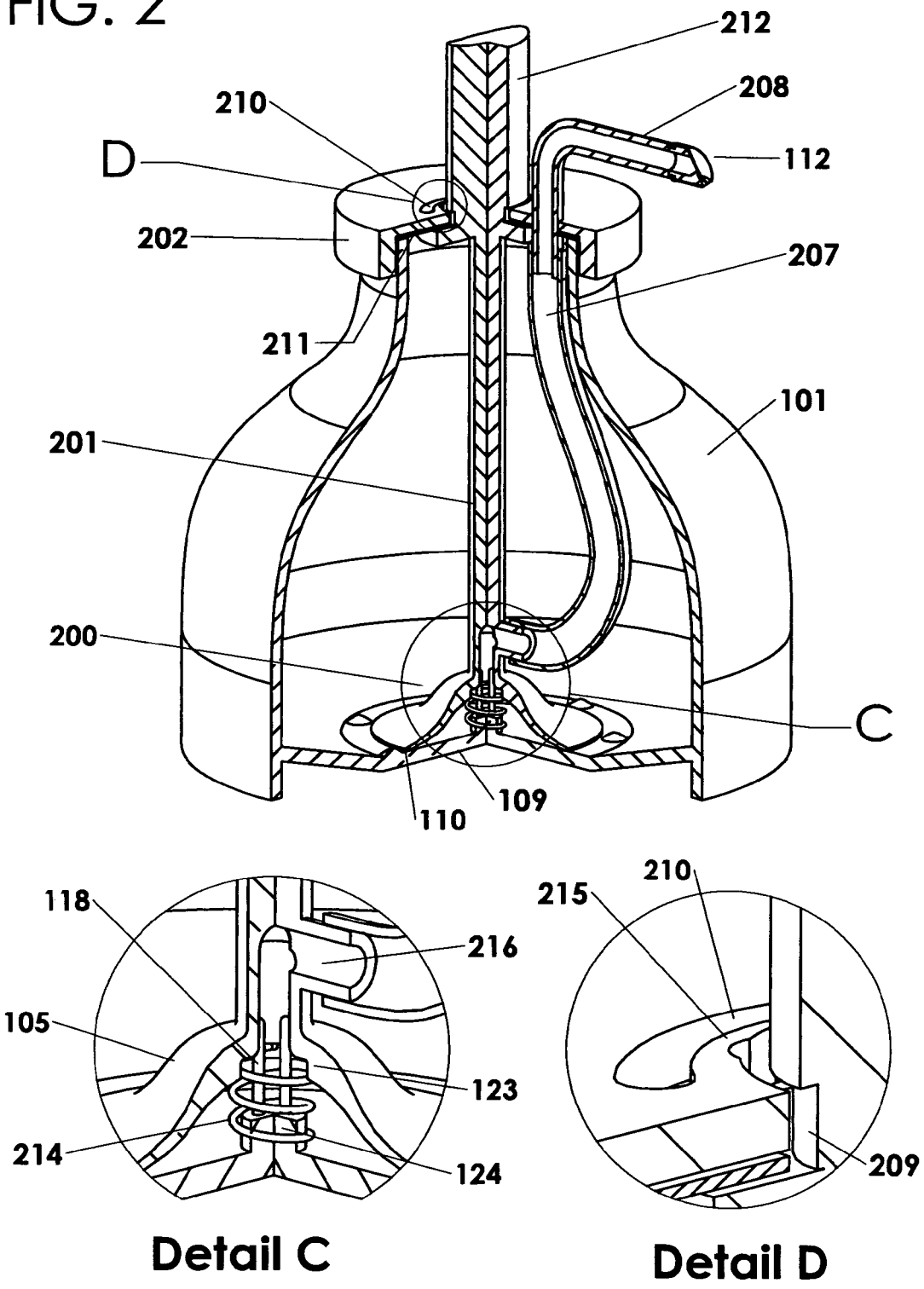
FIG. 2 shows various aspects of an alternate preferred embodiment.

FIG. 2, detail C shows an optional compression spring 214 that can be used to aid the refilling of the blister diaphragm 105. A spring was not shown in FIG. 1 because it hid details that will be discussed below, but would be placed within shoulder 123 at top, and over boss 124 at the bottom.

In FIG. 1 the tube 107 has a flange 116 that seals against the bottom of the bottle cap 102 by means of a gasket-seal 117 that may be part of the cap seal of bottle cap 102 as shown. The gasket-seal 117 is sealed without pressure on the thumb saddle 113 because blister diaphragm 105 and/or compression spring 214 are not quite allowed to return to their natural states which forces the gasket seal 117 to be closed. Only when the thumb saddle 113 is depressed, does the bottle 101 vent through the bottle cap hole 120 resulting in minimal air exposure protecting the fluid from drying and possibly suffering from chemical reactions with air.

Shown in FIG. 1, detail B is a locking mechanism for traveling; for example when the dispenser is placed in a suit case or a shipment box. This prevents the thumb saddle 313 from being accidently depressed to prevent fluid flow out of the vent gasket-seal 117 and nozzle 112. The bottle cap 102 has a plurality of concave cap tabs 121 that are captured by opposing convex skirt tabs 122 on skirt 115 to lock the bottle cap 102 to the skirt 115 securing the gasket seal 117. The skirt 115 and skirt tabs 122 are features of a single part that includes the tube 107, flange 116, thumb saddle 113, and spout 111 features. This locking mechanism requires twisting the spout 111 to latch the cap tabs 121 and skirt tabs 122. With the cap tabs 121 as part of the bottle cap 102, no extra parts are required to fabricate this locking mechanism. The tabs simply require that they engage each other, and of course these tabs can have different shapes than shown. An alternate locking method is shown in FIG. 2, detail D to be discussed below.

FIG. 1 shows a slide-pin 118 secured to the internal bottle bottom 109 that centers and prevents the blister diaphragm 105 from slipping from side to side and prevents the spout 111 or thumb saddle 113 to tip or wobble. This is a very important feature of the Blister Pump dispenser because it allows the dispenser parts to have significantly relaxed tolerances. In today's dispensers, because the spout is so close to the piston, tolerances between piston and cylinder must be about 0.002 inches to prevent a noticeable wobbling of the spout. With the blister diaphragm 105 at a much further distance from the spout, tolerances between pin and blister diaphragm can be about 0.020 inches before a noticeable wobbling of the spout 111 is observed through the cap hole 120. That is, tolerances are relaxed by a factor of ten. The slide-pin 118 in FIG. 1, detail A shows a plurality of legs 119 that guide tube 107 and blister diaphragm 105, but allows fluid to flow from blister diaphragm 105 through tube 107.

Alternatives

FIG. 2 shows a different way to activate an alternate Blister Pump 200 by pressing down on a more or less vertical rigid rod 201 by means of the alternate thumb saddle 212. In this case the alternate spout 208 would be fixed to the alternate bottle cap 202, and the flexible tube 207 is used to communicate fluid between the blister diaphragm 105 and alternate spout 208. One end of this flexible tube 207 is attached to the alternate spout 208 just below the alternate bottle cap 202, and the other end is attached to the rod tee 216 just above the blister diaphragm 105 (see FIG. 2, detail C). Standard methods are used for this attachment; for example, stretching the flexible tube over the alternate spout 208 and rod tee stubs 216. Venting is accomplished by a reduction of diameter with a rod groove 209 (see FIG. 2, detail D) in the rod 201 as it moves through alternate cap hole 210. A gasket 211 seals to prevent air exposure to the fluid in the bottle 101 when the rod 201 is no longer pressed, similar to the method discussed in FIG. 1. A compression spring 214 captured by boss 124 and shoulder 123 is shown in FIG. 2, detail C as discussed previously in the FIG. 1 embodiment.

An alternative locking mechanism is also shown in FIG. 2, detail D whereby a plurality of lock fingers 215 latch into the rod groove 209 when the rod 201 is twisted. In FIG. 2 the alternate thumb saddle 212 and alternate cap hole 210 are oval to prevent the rod 201 from wrapping the flexible tube 207 around itself if rod 201 is rotated more than the twist for latching. The rod 201, of course, could be round with a keyway through the bottle cap to prevent a complete rotation of the rod 201. Again, as in the description of FIG. 1, no extra parts are required for this locking mechanism.

The self-breaking means of seal 110 at the internal bottle bottom 109 at the end of the down stroke of the tube 107 or rod 201 of both dispensers in FIGS. 1 and 2 can be accomplished in several different ways other than that discussed in the FIG. 1 embodiment. FIGS. 3A to 3C show some of these alternatives:

a) FIG. 3A shows where the rough surface 311 of the outer bottom edge of bottom opening 108 is not so rough that it cannot create the edge seal 310 on the down stroke of the tube 107 or rod 201, but it is sufficiently rough to release the edge seal 310 as the outer edge 313 of the bottom opening 108 expands out radially.

b) FIG. 3B shows where a plurality of fulcrum bumps 312 inside the blister diaphragm 105 near the outer edge 313 act as a fulcrum that can leverage the edge seal 310 as the blister diaphragm 105 is compressed until edge seal 310 breaks open. The fulcrum bumps 312 could be made part of the internal bottle bottom 109 as another alternative.

c) FIG. 3C shows a plurality of slits 314 at the outer edge 313 of the blister diaphragm 105 open at the bottom of the down stroke of the tube 107 or rod 201. The slits are shown in the radial direction, but other directions near the periphery of the blister diaphragm 105 will work.

FIG. 3D shows another form of the blister diaphragm, the double blister-diaphragm 316. One of the steps in producing this prototype diaphragm was to sew two blister diaphragms 105 together at sewed edge 317. Of course, this shape can be made as a single part. This shape has some advantages because it requires much less force to release the seal 110 due to its smaller area. Here a rough surface 311 is all that is needed to release the seal at the internal bottle bottom 109. A spring can also be integrated into the diaphragm shape if desired.

FIGS. 4A to 4C show some alternatives to the slide-pin 118 attached to the internal bottle bottom 109. The function of the slide-pin 118 is to allow the top opening 106 of the blister diaphragm 105 to an up and down motion, but limit side to side motion, and still allow fluid to flow through the tubes (107 or 207). FIG. 4A shows the slide-pin 118 in FIGS. 1 and 2 with four legs 119. Obviously a different number of legs can be used. FIG. 4B shows the slide-pin 118 as a cylinder 403 with four slots 404. Obviously a different number of slots can be used. Finally, FIG. 4C shows the slide-pin 118 as a post 405 with a star cross-section 406 with 4 points. It is obvious that a different number of points can be used. In fact, slide-pin 118 can be a round bar (or one leg) with a diameter substantially smaller than the top opening 106 of the blister diaphragm 105. The top of any slide-pin 118 can be more tapered and/or made longer than indicated to ease the alignment of the tube 107 or rod 201 during assembly. Other designs for the same function would be obvious.

The channel valve nozzle 112 is designed to open when fluid is dispensed and channel the fluid into a narrow stream, then close after the dispensing is complete. Closure requires a positive force such as provided by a spring or stretched rubber sheet to ensure no leakage of the spout when dispenser is tipped or transported. This is in addition to the lock to prevent accidental pressing of the thumb saddle 113. In this way the fluid in the spout 111 or 208 is not exposed to air. Fluid remains in the spout 111 or 208 for instant dispensing; that is, there is no delay from the filling of the spout 111 or 208. The channel valve nozzle 112 prevents the fluid in the spout from drying and leaving a crusty residue or clog as well as prevents dripping at the end of the spout 111 or 208. Also, the channel valve nozzle 112 prevents fluid from draining fluid back into the bottle. The channel valve nozzle 112 can be accomplished in several different ways. FIGS. 5A. to 5F show some of these alternatives:

a) FIGS. 5A to 5C show one alternative. As shown in FIG. 5A, this is a one-piece nozzle. The cylindrical spring 505 has the piston 503 at one end and spring fingers 507 at the other end. In FIGS. 5B and 5C are cross-sections showing the spring fingers 507 engaged in the inner spout groove 506 inside the spout 111 or 208. When fluid is dispensed by depressing the tube 107 or rod 201, the piston 503 is forced out of the spout 111 or 208 to allow fluid to flow through the side hole channel 504 as shown in cross-section in FIG. 5B. When the pressure on the tube 107 or rod 201 is relaxed, the piston 503 moves back into the spout 111 or 208 by the cylindrical spring 505 to seal the fluid from the air as shown in cross-section in FIG. 5C. A stop 508 may be used to prevent the piston 503 from extending beyond the side hole channel 504. It is preferred that the piston 503 is made of a material (for example tetrafluoroethylene) that does not wet to the fluid to improve the air seal without a tight fit to the inside diameter of spout 111 or 208. That is, a thicker fluid seal is formed.

b) FIGS. 5D and 5E show another alternative. FIG. 5D shows the housing 513 that would be attached to a spout 111 or 208. The housing is basically an end plate that seals off the spout 111 or 102 at the exit end with a more or less vertical external channel 511 with an orifice 512 near the bottom within the channel. FIG. 5E shows the leaf spring 510 in a bent condition. The leaf spring 510 is fabricated flat, but has flexible spring like properties. The wide end 515 slips into the keyway 514 at the top of a housing 513 in FIG. 5D. The narrow end 516 presses against the bottom surface of channel 511 and seals orifice 512. The narrow end 516 of the leaf spring 510 lifts up when fluid is forced against it during the dispensing to allow fluid to flow down the channel 511 into the user's hand. When the dispensing stops the narrow part of the leaf spring 516 again moves back into the channel 511 to cover the orifice 512 and prevents air exposure to the fluid remaining in the spout 111 or 208. This channel valve nozzle 112 can be made with two parts, the housing 513 and leaf spring 510. The housing 513 can be attached to the spout 111 or 208 by spring fingers 521, gluing, or any other method.

c) FIG. 5F shows the alternative shown in FIGS. 1 and 2 in cross-section. A small balloon 517 is stretched over the exit end of spout 111 or 208. The balloon 517 has a rolled edge 518 at the left and a small off-center balloon hole 519 at the right. A thickened edge 522 at the bottom of the exit end of the spout 111 or 208 has a shallow conical partial channel 523 that does not quite reach to the aperture of the exit end of the spout 111 or 208, but extends to the outside diameter of the thickened edge 522. The balloon 517 is stretched over the exit end of the spout 111 or 208 such that the small balloon hole 519 in the balloon 519 expands over the thickened edge 522 and the rolled edge 510 snaps into the outer spout groove 524. The balloon hole 519 is always open. When fluid is dispensed, the edge of the stretched balloon hole 519 expands to allow fluid down the conical partial channel 523 into the user's hand. The balloon 517 seals off the aperture of the spout (111 or 208) when the fluid flow stops due to the tension of the balloon 517. This nozzle can be accomplished with one part; the balloon 517 or similar rubber-like membrane along with a slightly modified spout 111 or 208.

CONCLUSION, RAMIFICATIONS, AND SCOPE

Accordingly, from the description of this invention, the advantages of this dispenser become evident:

A manual dispenser that is of high quality; that is, dispenses a constant volume of fluid, works efficiently, is properly vented, and is of sturdy construction.

A dispenser that is inexpensive with fewer and simpler parts with relaxed tolerances and substantially less fabrication time. Surprisingly, this dispenser can be made of as few as 5 parts compared to the 12-15 parts of today's dispensers. An example of five parts would be as follows: bottle 101 (includes slide-pin 118 and bumps 114), bottle cap 102, blister diaphragm 105, tube 107 and spout 111 as one part, and a single part channel valve nozzle 112.

A dispenser that will add little to the cost of the fluid and can be considered disposable.

A dispenser wherein fluid does not dry and clog in the spout 111 or 208.

A dispenser where the fluid will not drip at the spout end of spout 111 or 208.

A dispenser where fluid is immediately dispensed without delay.

A dispenser where the fluid at the spout cannot be as easily contaminated by airborne germs (especially with multiple users and when dispensing food).

A dispenser where the last ounce of fluid in the bottle can be dispensed avoiding the user from having to fish for the last ounce or throwing it away in a wasteful fashion.

A dispenser where the bottle 101 is vented only when dispensing occurs. Fluid in bottle 101 is minimally exposed to air during the venting process.

A dispenser where fluid will not run out when the bottle 101 is tipped.

A dispenser with a simple locking mechanism is integrated into the dispenser for traveling purposes without increasing the part number.

Although the description above contains many specifications, these should not be construed as limiting the scope of the invention, but as merely providing illustrations of some of the presently preferred embodiments of this invention; for example, the bottle 101, blister diaphragm 105, tube 107, spout 111, or channel valve nozzle 112 do not have to have the cylindrically symmetric cross-sections. They could have rectangular, oval, or triangular cross-sections. Any scale or aspect ratios of the part dimensions are possible in this disclosure. It is obvious that dispenser materials must be compatible with the fluid being dispensed. For example, materials should not react nor dissolve in the fluid. Also it is clear this dispenser can be used to transfer any volume of fluid from one level to another for any purpose. Thus the scope of the invention should be determined by the appended claims and their legal equivalents rather than by the examples given.

The invention claimed is:

1. A manual dispenser of the type comprising:

a) a bottle of fluid, b) a diaphragm at internal bottom of said bottle, c) a tube and a spout in series attached to said diaphragm that communicates a measured quantity of said fluid within said diaphragm through said tube through said spout and out an exit end of said spout above said bottle and a cap of said bottle as said diaphragm is compressed manually by a pressing force on said spout and said tube, and d) a set of check valves to ensure said fluid flows one way out of said spout and allows said diaphragm to refill with said fluid when said pressing force is removed and said diaphragm returns to an uncompressed shape for the next dispensing cycle;

the following improvements comprising:

e) said diaphragm is a blister diaphragm having a top opening and a bottom opening that are more or less concentric to a vertical axis; when said blister diaphragm is pressed with said pressing force against said internal bottom, a bottom edge of said bottom opening forms a seal at said internal bottom and forces said fluid within said blister diaphragm up said top opening through said tube and said spout; said bottom edge expands substantially radially from said vertical axis over said internal bottom to a self-breaking means that breaks said seal to allow said blister diaphragm to refill when said pressing force is removed, f) a slide-pin to prevent said blister diaphragm, said tube, and said spout from wobbling during dispensing, but does not substantially impede flow of said fluid, g) a nozzle means that integrates a valve to allow said fluid to flow in one direction and a channel to confine said fluid into a stream;

whereby, said dispenser can be made from as few as five parts including said cap and said bottle; said parts are simple and have relaxed tolerances; fluid will not dry and clog said spout; and last ounce of said fluid will be dispensed.

2. The dispenser of claim 1 wherein said self-breaking means uses a plurality of bumps on said internal bottom outside but adjacent to said bottom edge such that said bottom edge lifts up to break said seal as bottom edge radially expands.

3. The dispenser of claim 1 wherein said self-breaking means uses a plurality of slits at said bottom edge that split open as said bottom edge radially expands across said internal bottom.

4. The dispenser of claim 1 wherein said self-breaking means uses a plurality of fulcrum bumps on bottom side of said blister diaphragm near said bottom edge such that as said bottom edge expands radially, said seal at said bottom edge is leveraged up until said seal breaks.

5. The dispenser of claim 1 wherein said self-breaking means uses a rough surface at said bottom edge of said blister diaphragm such that said fluid begins to flow through said seal as said bottom edge expands radially.

6. The dispenser of claim 1 wherein said slide-pin is one or more vertical legs attached to said internal bottom at said vertical axis of said blister diaphragm that slides into said top opening to align said blister diaphragm to said internal bottom.

7. The dispenser of claim 1 wherein said slide-pin is a hollow vertical cylinder with one or more side slots, said hollow vertical cylinder is attached to said internal bottom of said bottle at said vertical axis of said blister diaphragm that slides into said top opening of said blister diaphragm to align said blister diaphragm to said internal bottom.

8. The dispenser of claim 1 wherein said nozzle means uses a sliding piston attached to a spring, said spring and said piston within said spout, end of said spring away from said piston attached to inside said spout, said piston forms a sliding seal at the inside diameter near said exit end of said spout, said piston has a side hole channel such that when said fluid flows as said blister diaphragm is compressed, said piston will move out of said exit end to allow said fluid to flow through said side hole channel, and when said fluid flow stops, said piston is pulled back by said spring to reform said sliding seal.

9. The dispenser of claim 1 wherein said nozzle means uses a leaf spring within a more or less vertical channel on an end plate, said end plate is permanently attached across said exit end of said spout with said vertical channel and said leaf spring outside said spout, said vertical channel has an orifice near the lower end of said vertical channel for said fluid to flow when said fluid is dispensed, said leaf spring is fastened at the upper end of said vertical channel and extends over said orifice to seal said orifice such that said leaf spring bends and lifts at the bottom end of said leaf spring as said fluid flows through said orifice and down said vertical channel, and said leaf spring closes back into said vertical channel to reseal said orifice when said fluid stops flowing.

10. The dispenser of claim 1 wherein said nozzle means uses a rubber-like sheet that is stretched over an aperture of said exit end of said spout to form an aperture seal, said spout has a thickened wall at the lower edge of said exit end that has a more or less vertical partial channel that extends from just below said aperture to the outside edge of said thickened wall, such that when said fluid flows, said rubber-like sheet lifts to allow said fluid to flow out of said aperture down said partial channel, and when said fluid stops flowing, said rubber-like sheet reforms said aperture seal.

11. The dispenser of claim 1 wherein a compression spring is inserted within said blister diaphragm to assist said blister diaphragm to return to said uncompressed shape.

12. The dispenser of claim 1 wherein a separate rod is used to transmit said pressing force to compress said blister diaphragm rather than said tube and said spout.

13. The dispenser of claim 1 wherein cap tabs on said cap and tube tabs on said tube, when said tube is rotated relative to said cap, said tube tabs engage said cap tabs to lock tube from being depressed, whereby said dispenser cannot be accidently dispensed during shipment.

14. A manual dispenser of the type comprising:

a) a bottle of fluid, b) a diaphragm at an internal bottom of said bottle, c) a tube and a spout in series attached to said diaphragm that communicates a measured quantity of said fluid within said diaphragm through said tube through said spout and out an exit end of said spout above said bottle and a cap of said bottle as said diaphragm is compressed manually by a pressing force on said spout and said tube, and d) a set of check valves to ensure said fluid flows one way out of said spout and allows said diaphragm to refill with said fluid when said pressing force is removed and said diaphragm returns to an uncompressed shape for the next dispensing cycle;

the following improvements comprising:

e) said diaphragm is a double-blister diaphragm having a top opening, a bottom opening and a mid-section more or less concentric to a vertical axis, said mid-section is substantially larger than said top opening and said bottom opening, a bottom edge of said bottom opening has a rough surface; when said double-blister diaphragm is compressed by said pressing force against said internal bottom, said bottom edge forms a seal at said internal bottom and forces said fluid within said double-blister diaphragm up said top opening, through said tube, and through said spout, and said mid-section expands substantially radially from said vertical axis; when said pressing force is removed, said seal is broken by said rough surface to allow said fluid to refill said double-blister diaphragm, f) one or more vertical legs attached to said internal bottom of said bottle at said vertical axis of said double-blister diaphragm that slides into said top opening to align said double-blister diaphragm to said internal bottom, g) a nozzle means that integrates a valve to allow said fluid to flow in one direction and a channel to confine said fluid into a stream;

whereby, said dispenser can be made from as few as five parts including said cap and said bottle; said parts are simple and have relaxed tolerances; fluid will not dry and clog in said spout; and last ounce of said fluid will be dispensed.

15. The dispenser of claim 14 wherein a compression spring is integrated within said double-blister diaphragm to assist said double-blister diaphragm to return to said uncompressed shape.

16. The dispenser of claim 14 wherein said nozzle means uses a sliding piston attached to a spring, said spring and said piston within said spout, end of said spring away from said piston attached to inside said spout, said piston forms a sliding seal at the inside diameter near said exit end, said piston has a side hole channel such that when said fluid flows as said double-blister diaphragm is compressed, said piston will move out of said exit end to allow said fluid to flow through said side hole channel, and when said fluid flow stops, said piston is pulled back by said spring to reform said sliding seal.

17. The dispenser of claim 14 wherein said nozzle means uses a leaf spring within a more or less vertical channel on an end plate, said end plate is sealed permanently across said exit end of said spout, said vertical channel and said leaf spring are outside said spout, said vertical channel has an orifice near lower end of said vertical channel for said fluid to flow when said fluid is dispensed, said leaf spring is fastened at the upper end of said vertical channel and extends over said orifice to seal said orifice such that said leaf spring bends and lifts at the bottom end of said leaf spring as said fluid flows through said orifice and down said vertical channel, and said leaf spring closes back into said vertical channel to reseal said orifice when said fluid stops flowing.

18. The dispenser of claim 14 wherein said nozzle means uses a rubber-like sheet that is stretched over an aperture of said exit end of said spout to form an aperture seal, said spout has a thickened wall at the lower edge of said exit end that has a more or less vertical partial channel that extends from just below said aperture to the outside edge of said thickened wall, such that when said fluid flows, said rubber-like sheet lifts to allow said fluid to flow out of said aperture down said partial channel, and when said fluid stops flowing, said rubber-like sheet reforms said aperture seal.

19. The dispenser of claim 14 wherein cap tabs on said cap and tube tabs on said tube, when said tube is rotated relative to said cap, said tube tabs engage said cap tabs to lock tube from being depressed, whereby said dispenser cannot be accidently dispensed during shipment.

20. The dispenser of claim 14 wherein said tube has an attached flange that is pressed against a gasket at bottom of said cap to close off air exposure to said fluid in said bottle, accomplished by said double-blister diaphragm pushing said tube up because said flange does not allow said double-blister diaphragm to fully expand to said uncompressed shape; only when said tube is depressed does said flange move away from said gasket to allow venting of said bottle when said fluid is removed by dispensing, whereby said fluid is minimally exposed to air.

* * * * *